United States Patent [19]

Williams

[11] 4,086,772

[45] May 2, 1978

[54] METHOD AND APPARATUS FOR CONVERTING THERMAL ENERGY TO MECHANICAL ENERGY

[76] Inventor: Kenneth A. Williams, 14 S. Pine Cir., Belleair, Fla. 33516

[21] Appl. No.: 684,074

[22] Filed: May 7, 1976

Related U.S. Application Data

[63] Continuation-in-part of Ser. No. 618,936, Oct. 2, 1975, abandoned, which is a continuation-in-part of Ser. No. 753,921, May 2, 1975, abandoned.

[51] Int. Cl.[2] ..... F01K 25/04; F01K 25/10

[52] U.S. Cl. ..... 60/651

[58] Field of Search ..... 60/649, 650, 651, 670, 60/671, 641

[56] References Cited

U.S. PATENT DOCUMENTS 3,358,451 12/1967 Feldman et al. ..... 60/671 X

*Primary Examiner*—Allen M. Ostrager

*Attorney, Agent, or Firm*—Stuart J. Friedman

[57] ABSTRACT

A continuous method and closed cycle system for converting thermal energy to mechanical energy comprises vaporizing means for converting a liquid working fluid stream to a predominately, by volume, vapor or an all vapor stream; turbine means operated by the stream for converting a portion of the vapor stream energy to mechanical shaft work; means for increasing the thermal and potential energy of the turbine exhaust stream and for condensing it to a substantially liquid stream; and means for recycling the liquid stream to the vaporizing means.

The means for converting a working fluid liquid stream comprises a tube having a plurality of flow converging areas alternating with a plurality of flow diverging areas, each flow converging area confining said flow to a greater extent than the flow converging areas upstream thereof, and each flow diverging area expanding said flow to a greater extent than the flow diverging areas downstream thereof.

55 Claims, 3 Drawing Figures

METHOD AND APPARATUS FOR CONVERTING THERMAL ENERGY TO MECHANICAL ENERGY

This is a continuation-in-part of U.S. Application Ser. No. 618,936, filed Oct. 2, 1975, now abandoned, which application was a continuation-in-part of U.S. Application Ser. No. 753,921, filed May 2, 1975, now abandoned.

The present invention relates to mechanical energy generating systems and, more particularly, to a method and apparatus for converting thermal energy to mechanical energy.

As is universally appreciated, the world's supply of conventional fuels, such as natural gas, oil, coal, and the like, is being rapidly consumed and the continued availability of such fuels has, in recent years, been seriously questioned. Although these fuels are utilized for many purposes in our society, perhaps no uses are more important than as a source of thermal energy convertible to mechanical energy for furnishing motive power for vehicles and boats or to electrical energy for powering our households and industries. Of course, numerous alternative energy sources are available and under development, e.g., solar energy, nuclear energy, and the like, and to the extent that these alternative sources are utilized they will partially alleviate the present and prospective fuel crisis. However, nuclear energy, for example, is expensive and its use creates monumental environmental problems which remain unresolved. Solar energy as a source of power is still in the developmental stage and, at least at present, is not totally practical for use in all climates, particularly in areas where cloud, fog or smog cover is frequent. Indeed, there is not yet available a viable alternative to the ever increasing consumption of conventional fuels to supply the power necessary to operate today's society.

There have been however, numerous suggestions for systems which more efficiently utilize energy available from conventional sources by minimizing thermodynamic and fluid dynamic losses. Unfortunately, even these systems fail to significantly improve energy conversion efficiency and, generally, omit even to make maximum use of available energy conversion opportunities. For example, U.S. Pat. No. 3,358,451 discloses a system for converting the energy of a liquid stream to power by heating a liquid working fluid to form a two-phase fluid, accelerating the fluid, separating the liquid and vapor phases, converting the kinetic energy of the liquid phase to work, condensing the vapor phase to liquid and reuniting the liquid streams prior to heating again. This system, however, neglects to extract the maximum work potential from the available energy of the working fluid and, therefore, relinquishes, instead of using, valuable thermal energy to a heat transfer medium in a condenser.

It is therefore an object of the present invention to provide a system for producing mechanical energy which extracts more of the available work from a working fluid than has heretofore been possible.

It is another object of the present invention to provide a method for producing mechanical energy which need not consume or utilize the world's conventional fuel supply.

It is yet another object of the invention to provide an environmentally safe method for producing mechanical energy.

It is still another object of the invention to provide a method for producing mechanical energy from thermal energy where the thermal energy is derived from available ambient energy sources, such as the atmosphere, rivers, oceans, waste heat sources, etc.

It is another object of the invention to provide a method and system which is particularly useful in refrigeration and air conditioning applications and which substantially reduces the energy requirements for such applications.

Other objects and advantages will become apparent from the following description and appended claims, taken together with the accompanying drawings in which:

Figure 1:
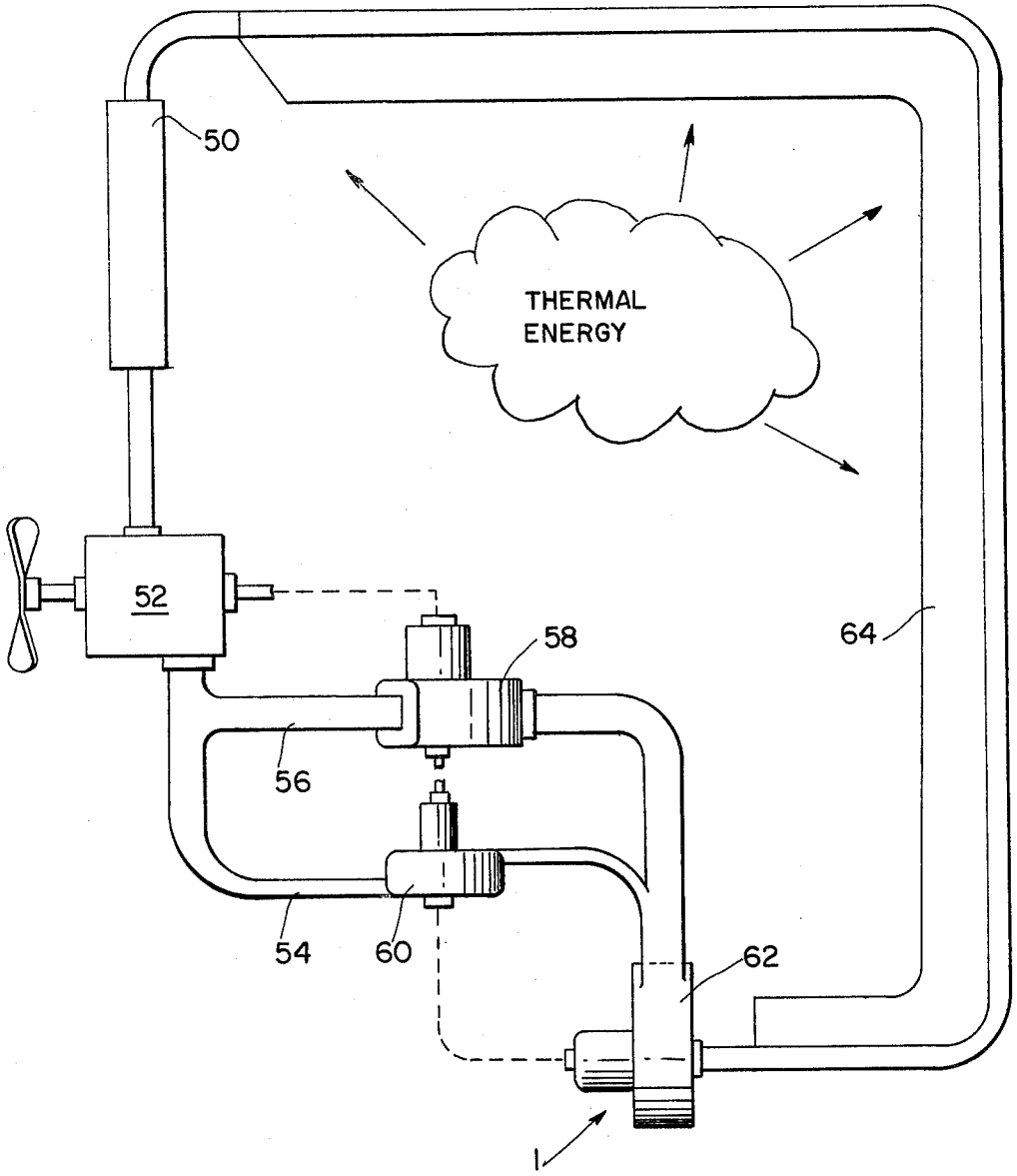
FIG. 1 illustrates, in schematic form, a preferred embodiment of the method and system of the present invention which utilizes only a single working fluid stream.

Referring to the drawings, and particularly to FIGS. 1, there is shown a continuous closed cycle system for converting the energy potential of an appropriately selected pressurized working fluid into mechanical shaft energy with system energy losses, including useful shaft work, made up by drawing energy, in the form of heat, from an available thermal energy source, such as radioisotopes, nuclear reactors, combustion heat (particularly from burning of non-conventional fuel sources such as garbage), solar energy and from ambient thermal sources where available in sufficient quantity (e.g., the atmosphere, rivers, oceans, waste heat sources, etc.). The system illustrated utilizes two working fluid streams or paths, a motive stream and a secondary stream. These streams may be of the same or of different working fluids. In another form, the system utilizes only one working fluid stream. Although there are numerous working fluids which may be used, as a general matter any liquid is suitable which is useful in an expansion work cycle taking into account the maximum and minimum temperatures and pressures of the selected cycle and the need for vaporization and condensation therebetween. For a system operating at or slightly above or below normal ambient temperatures those working fluids are most advantageous which are low boiling, and preferably those which boil substantially below the freezing point of water. Typical of these kinds of working fluids are carbon dioxide, liquid nitrogen and the fluorocarbons. Exemplary of useful fluorocarbons are difluoromonochloromethane, pentafluoromonochloroethane, difluorodichloromethane, and the mixtures and azeotropes thereof. For higher temperature, higher pressure systems the fluids may include water or other well known coolants, even including the liquid metals, e.g., sodium, potassium, mercury, and the like.

After passage through the tube 14 of the heat exchanger in the practice of the invention, the working fluid stream is directed to a means for converting the static pressure or potential energy of the stream to velocity or kinetic energy, such means hereinafter referred to as an energy conversion tube (ECT), as will be more fully described. In the ECT the velocity of the stream is caused to increase while at the same time causing the static pressure and temperature of the stream to substantially decrease. As the pressure decreases, some of the thermal energy contained in the liquid is liberated and a portion of the liquid is vaporized. The resulting stream contains an increased proportion, by volume, of vapor.

In a preferred form of the invention, the energy conversion tube includes a plurality of longitudinally spaced apart nozzle sections (see FIGS. 2 and 3) interconnected by a plurality of recovery sections. The liquid working fluid, having high potential or static energy (high static pressure), and being substantially saturated, as defined hereinafter, enters the first nozzle section and is accelerated therein to convert it to a high velocity, relatively lower static pressure stream or jet of fluid flowing axially through the tube. The velocity of the fluid increases, as does the kinetic energy, due to the decreasing cross-sectional flow area as the fluid moves through the nozzle section. As the fluid accelerates and the static pressure thereon decreases, the saturated liquid begin to vaporize and, in so doing, consumes some of its thermal energy. The result is an increased kinetic energy, decreased static pressure, decreased temperature and increased vapor content stream exiting the nozzle section. By "substantially saturated" as used herein, it is meant that the liquid is either saturated or so nearly saturated that under the flow conditions experienced in the first nozzle section, the liquid will vaporize at least in part. Most preferred is the condition wherein the liquid is in fact at saturation at the entrance to the first nozzle section of the ECT.

The high velocity fluid stream, consisting of a relatively high velocity liquid fraction and a substantially higher velocity vapor fraction, exits the nozzle section and enters a pumping and recovery section wherein the momentum of the vapor fraction is converted to additional velocity and increased temperature and static pressure of the liquid fraction. This is accomplished by transferring a portion of the kinetic and thermal energy of the vapor fraction to the liquid fraction whereby the liquid fraction is energized or regenerated for another expansion cycle through the next nozzle section. It is believed that in the pumping and recovery section, consistent with the conservation of momentum, the relatively fast moving vapor impacts with the relatively slow moving liquid resulting in a momentum exchange between liquid and vapor and a reduction in vapor fraction velocity. The velocity reduction is accompanied by a static pressure increase without a net expense of work (compression process) causing at least a portion or the vapor to condense and to transfer its latent heat of condensation to the liquid fraction. The net effect on the motive stream working fluid is to further increase the velocity and kinetic energy of the liquid, to condense most of the vapor, to recover a portion of the static pressure which was converted to kinetic energy in the nozzle section, and to increase working fluid temperature (to a value higher than at the nozzle section exit but lower than at the nozzle section inlet) so that the increased static pressure, increased temperature liquid is ready for further acceleration and expansion in the next nozzle section. The progressive temperature increase of the liquid through the pumping and recovery section is due to the vapor continuously applying its stagnation pressure to the liquid during the pumping process. This repeated vaporization-condensation sequence, occuring within the energy conversion tube, directs the work of vaporization downstream toward the low pressure area rather than more or less uniformly dissipating it in all directions. The effect is to create a pumping action upon the liquid stream with the result that a higher velocity, and thus a higher kinetic energy, is imparted to the liquid stream exiting the tube than would be observed in simple nozzling devices. Moreover, the use of a plurality of spaced nozzle sections permits a portion of both the latent and kinetic energy content of the vapor following initial nozzling to be transferred back to the liquid where its thermal portion is susceptible of reuse and conversion to additional kinetic energy. By contrast, in conventional systems, for example where only a single nozzle section is used, the latent thermal energy of the vapor is largely relinquished to the heat transfer medium in a condenser rather than being further used to do additional work. This recovery and reuse of the latent heat lies in the heart of the improved performance obtainable with the system of the present invention.

Figure 2:
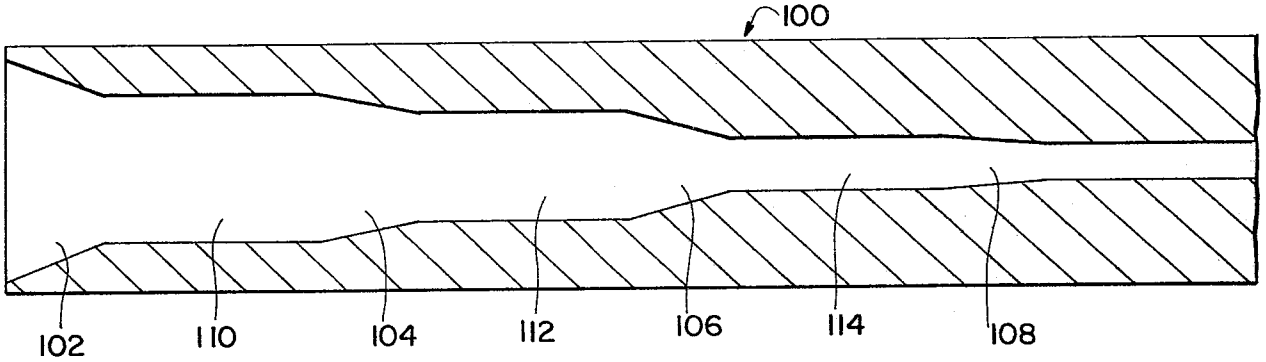
FIG. 2 illustrates an embodiment of an energy conversion tube useful in the system of the present invention.
Figure 3:
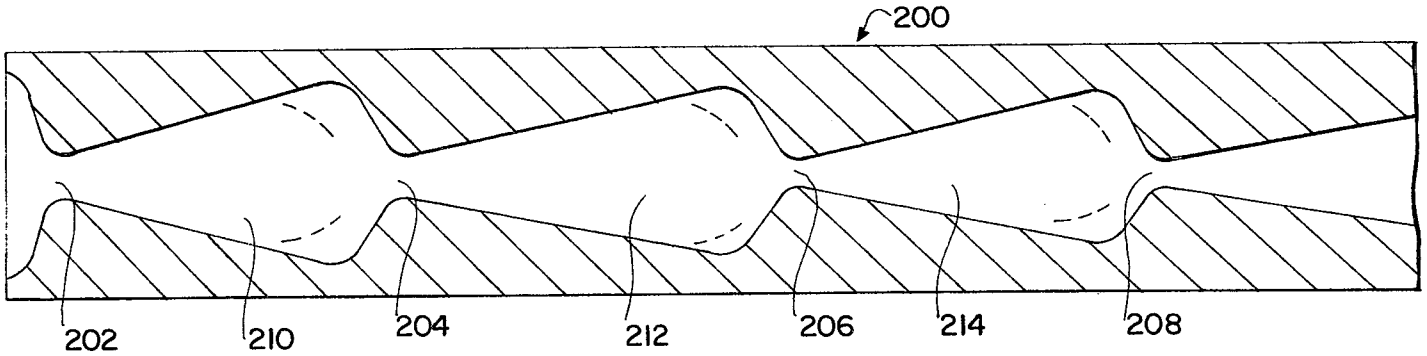
FIG. 3 illustrates a preferred form of energy conversion tube useful in the system of the present invention.

An energy conversion tube in its simplest form is shown in FIG. 2 at 100 and includes a plurality of spaced apart nozzle sections 102, 104, 106, 108 interconnected by a plurality of generally cylindrical recovery sections 110, 112, 114. In the embodiment illustrated in FIG. 3, energy conversion tube 200 comprises a plurality of longitudinally diverging diffuser sections 210, 212, 214. It is generally preferable to utilize diffuser sections as the recovery sections since they act as a controller preventing the static pressure front within the tube from being so low at any point that radial, rather than downstream directed, expansion of a liquid droplet occurs.

The energy conversion tube also desirably includes means for disrupting metastable flow conditions therein. Any of the numerous well known methods for disrupting metastable flow are suitably used. For example, a secondary flow stream, such as a mercury stream, may be added to the working fluid stream. Alternatively, mechanical means may be used, such as interposing diverters or turning vanes in the working stream. Still other methods for disrupting metastable flow involve use of non-mechanical means, e.g., using sound or radio waves. By disrupting metastable flow while at the same time utilizing spaced apart nozzle sections wherein the flow area of each nozzle section is smaller than the flow area of nozzle sections upstream thereof, the desired pumping action in the tube and increased liquid flow velocity can be achieved.

Referring to FIG. 1 it will be appreciated that the fluid employed can be any of the working fluids described hereinbefore. Since the system of FIG. 1 is continuous and closed, for descriptive purposes the inlet to ECT 50 has arbitrarily been selected as the system starting point. The fluid enters ECT 50 in liquid form, preferably saturated, at temperatures and pressures corresponding to an enthalpy content at least as high as the anticipated energy losses, including useful shaft work, in the system. In passing through ECT 50, which is a device similar to the energy conversion tube hereinbefore described, the potential energy of the fluid stream is partially converted to kinetic energy and the velocity of the stream is considerably increased while the static pressure and temperature of the stream is considerably decreased. Since kinetic energy is a function of both mass and velocity, where it is desirable to decrease flow velocity without decreasing stream kinetic energy the mass of the stream can be increased by adding a secondary flow stream, e.g., mercury. The addition of the secondary stream decreases the overall flow velocity while the mass increase keeps the kinetic energy substantially constant. The secondary stream also functions as an aid in disrupting metastable flow in the ECT. Vaporization of a portion of the liquid stream occurs within ECT 50 changing the physical nature of the stream from substantially all liquid to largely vapor, e.g., about 70–90% vapor by volume although only about 10–30% vapor by weight.

The relatively high velocity stream exiting ECT 50 impinges directly upon the blade portion of turbine 52 to convert a portion of the kinetic stream energy to mechanical shaft energy of the turbine. If desired, an optional throttle valve (not shown) can be inserted downstream of ECT 50 and upstream of turbine 52 to control the amount of kinetic energy converted in the turbine.

The stream exiting the turbine is spent and, if the system is to be continuous and closed and the spent stream is to be recycled, the energy content of the stream must be raised. This is preferably achieved by separating the liquid and vapor fractions of the turbine exhaust stream, increasing the static energy content of each fraction, and then recombining the fractions. One means of accomplishing the separation is by gravity separation, for example by vertically stacking the liquid and vapor fraction removal lines 54 and 56, respectively, with liquid line 54 below vapor line 56. In addition the diameter of vapor line 56 is made considerably larger (for example by a factor of 10) than the diameter of liquid line 54 to encourage the vapor-liquid separation. Vapor compressor or vapor pump 58 in line 56 and liquid pump 60 in line 54 operated by the shaft energy produced by turbine 52 increase the static pressure and energy content of the vapor and liquid fraction streams. At the same time the vapor compression in pump 58 increases the vapor temperature to a value considerably in excess of the liquid fraction temperature. The liquid and vapor streams are reunited downstream of pumps 58 and 60. The cold liquid serves as a heat sink for the vapor, for example by passing the vapor onto a thin film of the liquid in conventional fashion, causing substantially immediate vapor condensation so that the combined streams at the inlet to pump 62, which is also operated by the shaft energy produced by expansion engine 52, is substantially all liquid. Pump 62 is a liquid pump which increases the static pressure of the liquid stream to a pressure sufficient to handle, without vaporization, the thermal energy increase which the stream experiences in absorber section 64. At the same time, the pump increases the energy content of the stream.

Pumps 58, 60 and 62 also preform the necessary function of rapidly removing the turbine exhaust stream to prevent back pressure build-up at the turbine which could adversely affect its efficient operation. It will, of course, be appreciated that it is not necessary to employ a three pump arrangement as shown in FIG. 2. Instead, for example, a single centrifugal pump can be used in lieu of pumps 58-60, or indeed, any pump configuration is suitable which will perform the two basic functions of pumps 58, 60 and 62, i.e., to remove the turbine exhaust stream and to increase the static head and energy level thereof.

The liquid stream leaving pump 62 is directed through an absorber section 64 thermal energy is added to the system to make up for energy converted to mechanical shaft energy in the turbine 52 and for energy losses due to friction and other thermodynamic inefficiencies elsewhere in the system. The absorber section 64 should be of sufficient length or area to permit absorption of some predetermined quantity of energy and, to this end, the absorber section 64 includes control means (not shown) whereby the quantity of energy absorbed can be closely controlled. In passing through absorber section 64, the stream is re-energized to the desired extent by thermal absorption. The temperature of the stream leaving pump 62 should be considerably below the temperature of the thermal source in order that the stream may be re-energized to the desired extent by drawing upon the thermal energy available from the source. The amount of thermal energy added to the stream must be sufficient to make up for the energy converted to mechanical shaft energy in turbine 52 which is not added back into the stream in pumps 58, 60 and 62 and for energy losses due to friction and other thermodynamic inefficiencies elsewhere in the system. It will be appreciated, however, that whatever the thermal source employed, thermal energy must flow from it to the system. For this reason, until the thermal source is selected and its thermal conditions are defined, an appropriate working fluid and the pressure and temperature parameters of any particular system cannot be finally selected. The stream leaving absorber section 64 is substantially saturated and has a sufficient energy content to start the cycle over again at the inlet to nozzle 50. Alternatively, if desired to control the net power output, some thermal energy could be added to the fluid prior to adding the static energy thereto.

The following example is intended to illustrate one set of operating parameters for a system in which the thermal energy source is the ambient (postulated to be in the range 85°–100° F) and in which Freon 22, commercially available from E. I. duPont de Nemours & Company, Inc., is utilized as the working fluid.

EXAMPLE II

Freon, difluoromonochloromethane, was employed as the working fluid in the system illustrated in FIG. 1. The fluid energy content parameters in BTU per pound of working fluid at the indicated locations in the system as well as energy additions (+) to and energy losses (−) from the system are set forth below:

AT THE ECT INLET AT THE ABSORBER SECTION OUTLET

Assuming the working fluid to be a liquid having no substantial velocity, all of the fluid energy is potential, i.e. static and thermal (hereinafter "PE") and none is kinetic (hereinafter "KE"):

PE = 33.7 BTU/lb.
KE = 0

AT THE ECT OUTLET AT THE TURBINE INLET

PE = 23.7 BTU/lb
KE = 10.0 BTU/lb

AT THE TURBINE OUTLET AT THE INLETS TO PUMPS 58 and 60

PE = 27.1 BTU/lb.
Work done by fluid in turbine, assuming a turbine inefficiency loss of 33% = −6.6 BTU/lb.

IN THE ABSORBER SECTION

Thermal energy transferred from source = +4.2 BTU/lb.

As hereinabove indicated, once thermal source temperature conditions are known and the desired turbine mechanical energy output is selected, the turbine exhaust stream temperature can be determined and from this value an appropriate working fluid and minimum pressure and temperature operating parameters can be identified. In this connection, while it is appreciated that there is considerable latitude, from the standpoint of operability, in selecting temperature and pressure operating parameters, the size and cost of the system components are closely related to the operating temperatures and pressures. Thus, as a practical matter, the ultimate use of the system, e.g., for vehicle motive power wherein size may be critical or as a home power source wherein size may not be very important, may influence the physical size of the system and thereby limit the choice of operating temperature and pressure parameters.

While the present invention has been described with reference to particular embodiments thereof, it will be understood that numerous modifications can be made by those skilled in the art without actually departing from the scope of the invention. Accordingly, all modifications and equivalents may be resorted to which fall within the scope of the invention as claimed.

What is claimed as new is as follows:

1. A continuous method for converting thermal energy to mechanical energy comprising the steps of:

(a) providing a working fluid stream in a substantially saturated liquid state containing a predetermined quantity of thermal and static energy therein;

(b)

(i) converting the static energy of said fluid stream to kinetic energy by accelerating said stream whereupon a high velocity, reduced temperature and static pressure stream is obtained, said fluid vaporizing in part under the reduced pressure to form a vapor fraction in said liquid stream, said vapor fraction having a greater velocity than said liquid fraction;

(ii) transferring a portion of the vapor fraction momentum and thermal energy to said liquid fraction whereby said vapor fraction is compressed and a major portion of said vapor fraction condenses transferring a portion of its heat of condensation to said liquid fraction, said liquid fraction increasing in velocity, static pressure and temperature;

(c) repeating step (b) at least once;

(d) extracting energy from said two phase stream and converting said energy to shaft work;

(e) adding sufficient static energy to said stream to condense a major proportion by volume of the vapor fraction thereof and to permit the addition to said stream, without vaporization, of thermal energy sufficient for at least one additional cycle of said stream;

(f) passing said stream in heat absorbing relation with a source of thermal energy whereby said stream absorbs thermal energy from said source; and (g) repeating steps (b) through (g),

2. A method, as claimed in claim 1, wherein said static energy added to step (e) raises the static energy level of said fluid stream to at least said predetermined quantity of step (a).

3. A method, as claimed in claim 1, wherein said thermal energy absorbed in step (f) raises the thermal energy level of said fluid stream to at least said predetermined quantity of step (a).

4. A method, as claimed in claim 1, wherein said stream is separated into its liquid and vapor fractions before at least a portion of said static energy is added thereto.

5. A method, as claimed in claim 4, wherein said separated vapor fraction is compressed; the static pressure of said separated liquid fraction is increased; said vapor and liquid fractions are intermixed whereby said vapor condenses in said liquid; the static pressure of said liquid resulting from intermixing said fractions is increased sufficiently to permit said sufficient amount of thermal energy to be added thereto; and, said pressurized liquid is placed in heat absorbing relation with said source of thermal energy.

6. A method, as claimed in claim 1, wherein said source of thermal energy is an ambient energy source.

7. A method, as claimed in claim 6, wherein said ambient source is selected from the atmosphere, water, and waste thermal energy sources.

8. A method, as claimed in claim 1, wherein said static energy of said working fluid stream is converted to kinetic energy by passing said fluid in substantially saturated liquid state through more than one area of constricted flow.

9. A method, as claimed in claim 8, wherein said fluid is passed through a plurality of flow converging areas alternating with a plurality of flow diverging areas, each flow converging area confining said flow to a greater extent than the flow converging areas upstream thereof, and each flow divertging area expanding said flow to a greater extent than the flow diverging areas downstream thereof.

10. A method, as claimed in claim 8, wherein said working fluid stream is passed through a plurality of areas of constricted flow, each said area having a greater flow constriction than the areas upstream thereof.

11. A method, as claimed in claim 10, wherein said working fluid is selected from the group consisting of carbon dioxide, liquid nitrogen and fluorocarbons.

12. A method, as claimed in claim 11, wherein said working fluid is a fluorocarbon selected from the group consisting of difluoromonochloromethane, pentafluoromonochloroethane, difluorodichloromethane, and mixtures thereof.

13. A method, as claimed in claim 10, wherein said areas are spaced apart in the flow direction.

14. A method, as claimed in claim 13, wherein said flow through said areas is disrupted to prevent metastable flow conditions therein.

15. A method, as claimed in claim 14, wherein a secondary flow stream is added to said flow whereby said flow is disrupted and slowed.

16. A method, as claimed in claim 14, wherein mechanical means are interposed in said flow stream to disrupt said flow.

17. A method, as claimed in claim 14, wherein wave energy is applied to said flow stream to disrupt said flow.

18. A continuous method for converting thermal energy to mechanical energy comprising the steps of:

(a) providing a working fluid stream in a substantially saturated liquid state containing a predetermined quantity of thermal and static energy therein, said liquid selected from the group consisting of carbon dioxide, liquid nitrogen and the fluorocarbons and having the characteristic of boiling below the freezing point of water;

(b) passing said working fluid stream through a plurality of spaced apart areas of constricted flow, each said area having a greater flow constriction than the areas upstream thereof and disrupting flow through said areas to prevent metastable flow therein to convert a portion of the static energy of said fluid stream to kinetic energy whereby a portion of said liquid stream vaporizes;

(c) extracting kinetic energy from said two phase stream in a turbine whereby said extracted energy is converted by said turbine into shaft work;

(d) separating the two phase stream exiting the turbine into its liquid and vapor fractions;

(e) compressing the vapor fraction whereby its temperature and static energy content increases;

(f) increasing the static energy content of said liquid fraction;

(g) intermixing said liquid and vapor fractions whereby said relatively warm vapor condenses in said relatively cool liquid;

(h) increasing the static energy content of said condensed vapor and liquid stream to permit thermal energy addition thereto, without vaporization, sufficient for at least one additional cycle of said stream;

(i) passing said liquid stream from (h) in heat absorbing relation with an ambient thermal energy source whereby said stream absorbs thermal energy from said source; and (j) repeating steps (b) through (j).

19. A method, as claimed in claim 18, wherein said static energy of said fluid is converted to kinetic energy by passing said fluid in liquid state through a plurality of flow converging areas alternating with a plurality of flow diverging areas, each flow converging area confining said flow to a greater extent than the flow converging areas upstream thereof, and each flow diverging area expanding said flow to a greater extent than the flow diverging areas downstream thereof.

20. A method, as claimed in claim 18, wherein mechanical means are interposed in said flow stream to disrupt said flow.

21. A closed cycle system for converting thermal energy to mechanical energy comprising:

(a) vaporizing means for converting a portion of a liquid working fluid to vapor;

(b) turbine means coupled to said vaporizing means for receiving said liquid and vapor containing stream therefrom, said turbine means extracting energy from said stream and converting said energy to shaft work;

(c) means for increasing the thermal and static energy content of the fluid stream exiting said turbine means;

(d) means for condensing the vapor fraction of said stream exiting said turbine means; and (e) means for recycling said condensed stream to said vaporizing means.

22. A system, as claimed in claim 21, wherein said means for condensing said vapor fraction in said stream comprises diffuser means.

23. A system, as claimed in claim 21, wherein said means for increasing the thermal energy of said stream comprises an ambient thermal energy source in heat exchange contact with which said stream is passed.

24. A system, as claimed in claim 23, wherein said working fluid is selected from the group consisting of carbon dioxide, liquid nitrogen and the fluorocarbons.

25. A system, as claimed in claim 24, wherein said fluid is a fluorocarbon selected from the group consisting of difluoromonochlormethane, pentafluoromonochlorethane, difluorodichloromethane, and mixtures thereof.

26. A system, as claimed in claim 25, wherein said fluid is an azeotrope of difluoromonochloromethane and pentafluoromonochloroethane.

27. A system, as claimed in claim 23, wherein said means for increasing the static energy content of said stream comprises pump means.

28. A system, as claimed in claim 27, wherein said pump means is operated by said shaft work produced in said turbine means.

29. A system, as claimed in claim 27, wherein said vaporizing means comprises a plurality of spaced apart nozzle sections and said vaporizing means converts a major proportion of the static energy of said working fluid to kinetic energy.

30. A system, as claimed in claim 29, wherein said plurality of nozzle sections includes a plurality of spaced apart constricted flow areas, each said area having a greater flow constriction than the areas upstream thereof.

31. A system, as claimed in claim 30, wherein said nozzle sections are separated by diffuser sections such that said converting means comprises a plurality of alternating nozzle and diffuser sections, the first section of said converting means being a nozzle section.

32. A system, as claimed in claim 31, wherein said nozzle sections comprise flow converging areas and said diffuser sections comprise flow diverging areas, each flow converging area confining said flow to a greater extent than the flow converging areas upstream thereof, and each flow diverging area expanding said flow to a greater extent than the flow diverging areas downstream thereof.

33. A system, as claimed in claim 29, wherein said means for condensing vapor comprises means for separating said working fluid stream into its liquid and vapor fractions, first and second pump means for increasing the static energy content of said liquid and vapor fractions, respectively, and for increasing the temperature of said vapor fraction, and means for intermixing said fractions whereby said relatively warm vapor fraction condenses in said relatively cool liquid fraction.

34. A system, as claimed in claim 33, wherein said second pump means for increasing the static energy content of and the temperature of said vapor fraction is a vapor compressor.

35. A system, as claimed in claim 33, wherein said means for increasing the static energy of said stream comprises third pump means disposed downstream of said intermixing means.

36. A system, as claimed in claim 35, wherein said ambient thermal energy source is disposed downstream of said third pump means.

37. A system as claimed in claim 29, including means associated with said nozzle sections for preventing metastable flow conditions therein.

38. A system, as claimed in claim 37, wherein said means comprise mechanical flow disruptors.

39. A system, as claimed in claim 37, wherein said means comprises wave energy applied to said working fluid.

40. A closed cycle system for converting thermal energy to mechanical energy comprising:

(a) means for converting a portion of the static energy of a liquid working fluid stream to kinetic energy and for vaporizing a portion of said stream, said means comprising a plurality of nozzle sections alternating with a plurality of diffuser sections, the first section of said converting means being a nozzle section, said nozzle sections comprising flow converging areas and said diffuser sections comprising flow diverging areas, each flow converting area confining said flow to a greater extent than the flow converging areas upstream thereof, and each diverging area expanding said flow to a greater extent than the flow diverging areas downstream thereof;

(b) a turbine coupled to said converting means for receiving said two phase fluid stream therefrom, said turbine extracting kinetic energy from said stream and converting said kinetic energy to shaft work;

(c) means for gravity separating said stream exiting said turbine into its liquid and vapor fractions;

(d) vapor compressor means for receiving said vapor fraction and for increasing the static energy content thereof while simultaneously increasing the temperature thereof;

(e) first liquid pump means for receiving said liquid fraction and for increasing the static energy content thereof;

(f) means downstream of said vapor compressor means and said first liquid pump means for receiving and intermixing said vapor and liquid fractions whereby said relatively warm vapor fraction condenses in said relatively cool liquid fraction;

(g) second liquid pump means for increasing the static energy content of said condensed fluid stream;

(h) an ambient thermal energy source for passing said increased static energy stream in heat exchange contact therewith, whereby said stream absorbs thermal energy from said source; and (i) means for returning said working fluid stream to said converter means.

41. A system, as claimed in claim 40, including mechanical flow disruptors associated with said nozzle sections for preventing metastable flow conditions therein.

42. A continuous method for converting thermal energy to mechanical energy comprising the steps of:

(a) providing at least one working fluid stream in a substantially saturated liquid state containing a predetermined quantity of thermal and static energy therein;

(b) vaporizing a major proportion by volume of said at least one stream to obtain a liquid and vapor phase stream;

(c) extracting energy from said two phase stream and converting said energy into shaft work;

(d) passing said stream in heat absorbing relation with a source of thermal energy whereby said stream absorbs at least sufficient thermal energy from said source for at least one additional cycle;

(e) condensing said vapor fraction in said stream;

(f) adding sufficient static energy to said liquid stream to permit at least one additional cycle of said stream; and (g) repeating steps (b) through (g).

43. A method, as claimed in claim 42, wherein said static energy of said at least one working fluid stream is converted to kinetic energy by passing said first stream through more than one area of constricted flow.

44. A method, as claimed in claim 43, wherein said source of thermal energy is an ambient energy source.

45. A method, as claimed in claim 43, wherein said fluid is passed through a plurality of flow converging areas alternating with a plurality of flow diverging areas, each flow converging area confining said flow to a greater extent than the flow converging areas upstream thereof, and each flow diverging area expanding said flow to a greater extent than the flow diverging areas downstream thereof.

46. A method, as claimed in claim 44, wherein said ambient source is selected from the atmosphere, water and waste thermal energy sources.

47. A method, as claimed in claim 43, wherein said static energy added in step (f) raises the static energy level of said stream to at least said predetermined quantity of step (a).

48. A method, as claimed in claim 43, wherein said working fluids are selected from the group consisting of carbon dioxide, liquid nitrogen and the fluorocarbons.

49. A method, as claimed in claim 48, wherein said fluids are fluorocarbons selected from the group consisting of difluoromonochloromethane, pentafluoromonochloroethane, difluorodichloromethane, and mixtures thereof.

50. A method, as claimed in claim 49, wherein at least one of said fluids is an azeotrope of difluoromonochlormethane and pentafluoromonochloroethane.

51. A method, as claimed in claim 43, wherein said working fluid stream is passed through a plurality of areas of constricted flow, each said area having a greater flow constriction than the areas upstream thereof.

52. A method, as claimed in claim 51, wherein said areas are spaced apart in the flow direction.

53. A method, as claimed in claim 51, wherein said flow through said areas is disrupted to prevent metastable flow conditions therein.

54. A method, as claimed in claim 53, wherein mechanical means are interposed in said flow stream to disrupt said flow.

55. A method, as claimed in claim 53, wherein wave energy is applied to said flow stream to disrupt said flow.

* * * * *

UNITED STATES PATENT AND TRADEMARK OFFICE

CERTIFICATE OF CORRECTION

PATENT NO. : 4,086,772

DATED : May 2, 1978

INVENTOR(S) : Kenneth A. Williams

It is certified that error appears in the above-identified patent and that said Letters Patent are hereby corrected as shown below:

On the Cover Sheet under Related U.S. Application Data, "Ser. No. 753,921" should be --Ser. No. 573,921--.

Column 1, line 8, "Ser. No. 753,921" should be --Ser. No. 573,921--.

Signed and Sealed this

*Third* Day of *October 1978*

[SEAL]

*Attest:*

RUTH C. MASON
*Attesting Officer*

DONALD W. BANNER
*Commissioner of Patents and Trademarks*